US011027796B1

(12) United States Patent
Teboul

(10) Patent No.: US 11,027,796 B1
(45) Date of Patent: Jun. 8, 2021

(54) HYDROFOIL WATERCRAFT AND METHOD OF MANUFACTURE OF THE SAME

(71) Applicant: Forward Maui LLC, Haiku, HI (US)

(72) Inventor: Keith Teboul, Haiku, HI (US)

(73) Assignee: Forward Maui LLC, Haiku, HI (US)

( * ) Notice: Subject to any disclaimer, the term of this patent is extended or adjusted under 35 U.S.C. 154(b) by 0 days.

(21) Appl. No.: 17/144,384

(22) Filed: Jan. 8, 2021

(51) Int. Cl.
*B63B 32/66* (2020.01)

(52) U.S. Cl.
CPC ..... *B63B 32/66* (2020.02)

(58) Field of Classification Search
CPC ..... B63B 32/66
See application file for complete search history.

(56) References Cited

U.S. PATENT DOCUMENTS 3,747,138 A * 7/1973 Morgan ..... B63B 32/60 441/74
9,011,191 B2 * 4/2015 Connor ..... B63B 32/60 441/74
10,759,503 B2 * 9/2020 Aguera ..... B63B 32/60

OTHER PUBLICATIONS

Stu Nettle, Water flowing over glass: A conversation with Phil Myers; Swellnet.com Oct. 19, 2017 [retrieved from the internet on Jan. 7, 2021] https://www.swellnet.com/news/talking-heads/2017/10/19/water-flowing-over-glass-conversation-phil-myers; 21 pages.
Phil Myers, Phil Myers / Ballina; oldschool-resistance.com; Mar. 7, 2018 [retrieved from the internet on Jan. 7, 2021] https://oldschool-resistance.com/2018/07/03/phil-myers-ballina/; 6 pages.
Spyder Surfboards, spydersurf.com; published Mar. 17, 2018 [retrieved from the internet on Jan. 7, 2021] https://spydersurf.com/collections/surfboards/products/fireball; 19 pages.
Proton Pro IV Race Single, goyawindsurfing.com; published Apr. 27, 2020 [retrieved from the internet on Jan. 7, 2021] https://goyawindsurfing.com/boards/y2021/proton-pro-4/; 6 pages.
Drifter Pro Surfing Foilboard, ktsurfing.com; published Oct. 5, 2019 [retrieved from the Internet on Jan. 7, 2021] https://ktsurfing.com/boards/drifter-pro/; 8 pages.
Drifter F Full Foil, ktsurfing.com; published Jul. 13, 2020 [retrieved from the internet on Jan. 7, 2021] https://ktsurfing.com/boards-2021/drifter-f/; 6 pages.
Drifter S Slim Foil, ktsurfing.com; published Jul. 13, 2020 [retrieved from the internet on Jan. 7, 2021] https://ktsurfing.com/boards-2021/drifter-s/; 6 pages.

* cited by examiner

*Primary Examiner* — S. Joseph Morano
*Assistant Examiner* — Jovon E Hayes
(74) *Attorney, Agent, or Firm* — Esplin & Associates, PC

(57) ABSTRACT

A hydrofoil watercraft, in particular, a hydrofoil board is described herein. The hydrofoil board may comprise one or more of a body, a hydrofoil assembly, and/or other components. The body may have one or more of a deck surface configured to support a rider, a bottom surface opposite the deck surface, and/or other surfaces and/or features. The body may comprise a fore portion having a planing surface forming part of the bottom surface. The body may have an aft portion having an aft bottom surface forming part of the bottom surface. The fore portion may be toward a front end of the board. The aft portion may be toward a rear end of the board. An aft cross-sectional thickness between the deck surface and the aft bottom surface may be less than a fore cross-sectional thickness between the deck surface and the planing surface.

14 Claims, 7 Drawing Sheets

HYDROFOIL WATERCRAFT AND METHOD OF MANUFACTURE OF THE SAME

FIELD OF THE DISCLOSURE

This disclosure relates to a hydrofoil watercraft and method of manufacture of the same.

BACKGROUND

Some recreational watercrafts utilize hydrofoil assemblies to provide an exciting and more efficient way to traverse and glide through water. A hydrofoil board, sometimes referred to as a "foilboard," may comprise a surfboard with a hydrofoil assembly that extends below the board into the water. This design may cause the board itself to leave the surface of the water at various speeds such that the rider and the board become fully supported by the hydrofoil assembly (e.g., "foiling").

SUMMARY

One or more aspects of the present disclosure relate to a hydrofoil watercraft. In particular, one or more aspects of present disclosure may be related to a hydrofoil board that is primarily controlled by a rider. The hydrofoil board may be a wave riding board, or a board built for other intended purposes. The hydrofoil board may powered or non-powered. Power may be provided by a propulsion system in the hydrofoil assembly and/or the board. It is noted, however, that one or more features and/or functionality described herein may be carried out on other watercraft, powered and non-powered. Accordingly, those skilled in the art may appreciate some modifications that may be carried out in the other watercraft in order to implement one or more of the features and/or functionality described herein without departing from the scope and intent of the present disclosure.

Traditional hydrofoil boards may comprise a surfboard body forming a hull. The surfboard may have a deck surface ("top surface") to support a rider and a planing surface ("bottom surface") that provides a surface upon which the surfboard planes atop a surface of a body of water. Both the deck surface and the planing surface may be continuous and even from nose to tail, although sometimes curvature, or "rocker", may be present. In some implementations, one or more channels may be built into the bottom surface which may communicate from the nose to the tail and/or other portion therebetween. Because of the unique way that hydrofoil boards function—the board itself leaves the surface of the water such that the rider and the board become fully supported by a hydrofoil assembly—the inventor of the present disclosure has identified a unique problem that has yet to been addressed in these and other types of watercraft.

The unique problem that has yet to been addressed in hydrofoil boards and other types of watercraft is related to the fact that the board must leave the surface of the water before being fully supported by the hydrofoil assembly. Riding the board when fully supported by the hydrofoil assembly, sometimes called "foiling," is most efficient when the board is not in contact with the water. When a rider initially takes off on a hydrofoil board, by one or more of paddling, riding down a wave, being propel by a sail, wing, kite, and/or being propelled (e.g., by a powered hydrofoil, board, or boat), the board starts to move atop the surface of water causing the board to plane and/or displace water. As the board starts to move faster, the hydrofoil starts generating a more powerful lift that eventually detaches the bottom surface of the board from the water. The contact of the board along the surface of the water creates adhesion between the planing surface of the board and the surface of the water, which further causes drag. This adhesion must overcome for the board to ultimately leave the surface of the water to thereby eliminate the drag. These forces act to constrain the board from detaching from the water and/or actively act to attach the board to the surface of the water. Since the planing surface is typically continuous and even from nose to tail, this creates a relatively large surface area to adhere to the surface of the water. As the board gains more speed, the hydrofoil assembly provides more upward force, or "lift", and the board is able to break the adhesion from the surface of the water. However, given the relatively large surface area created by the typical configuration of the planing surface, the board must achieve considerable speed before the bottom of the board can break the adhesion with the water. Manually gaining such speed by paddling, or through the power of a wing, kite, sail, and/or propulsion system may be difficult for the average recreational user given the drag, and may still be difficult or take longer than desired for professional riders of the highest physical fitness. In some instances, gaining the requisite speed may require a relatively larger, more powerful kite, sail, wing, foil and/or propulsion system, and/or steep wave to assist in propelling the board. One or more benefits of foiling is that a rider can foil in less than average conditions, and can even paddle into whitewater and take off, as foiling does not rely much on the shape or surface of the wave. Instead, the rider just needs to gain some forward speed or moving swell for the foil to gain lift. Some advanced riders can even run and pump the foil off the beach on flat water, generating their own speed by pushing the foil up and down, generating sufficient displacement to stay on the foil.

One or more aspects of the present disclosure propose solutions to these and/or other problems by providing a hydrofoil board which reduces the wetted surfaces (e.g., having a reduced surface area of a planing surface compared to traditional boards) without sacrificing overall length and/or volume of the board. The hydrofoil board may be powered or non-powered. The hydrofoil board may be utilized in one or more of wave riding (e.g., surfing), flat water riding, wake riding, kite surfing, and/or other methods of riding.

In some implementations, the hydrofoil board may comprise one or more of a body, a hydrofoil assembly, and/or other components. The body may have one or more of a deck surface configured to support a rider, a bottom surface opposite the deck surface, and/or other surfaces and/or features. The bottom surface may be comprised of one or more parts. Briefly, the parts may include a planing surface toward the front of the board, and a surface toward a rear of the board. The planing surface may be offset from the surface toward the rear of the board such that the surface toward the rear of the board may not be considered a traditional planing surface. That is, the surface toward the rear of the board may not be utilized for planing atop a surface of water. The surface toward the rear of the board may be where a hydrofoil assembly attaches to the board.

In some implementations, the body may be comprised of one or more of a fore portion, an aft portion, and/or other portions and/or components. The fore portion may be disposed toward a front end of the hydrofoil board. The front end may include a "nose" of the board. The fore portion may form a hull. The fore portion may have a planing surface upon which the hydrofoil board planes atop a surface of a body of water. The planing surface may form part of the bottom surface of the body.

The aft portion may be disposed toward a rear end of the hydrofoil board. The rear end may include a "tail" of the board. The aft portion may have an aft bottom surface forming part of the bottom surface of the body. The aft portion may be configured such that it may extend from the fore portion. In some implementations, the deck surface may be substantially even across the fore portion and the aft portion of the body. In some implementations, the aft bottom surface and the planing surface may be on uneven planes such that an aft cross-sectional thickness between the deck surface and the aft bottom surface may be less than a fore cross-sectional thickness between the deck surface and the planing surface. The aft portion may be configured to mount a hydrofoil assembly on or through the aft bottom surface.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
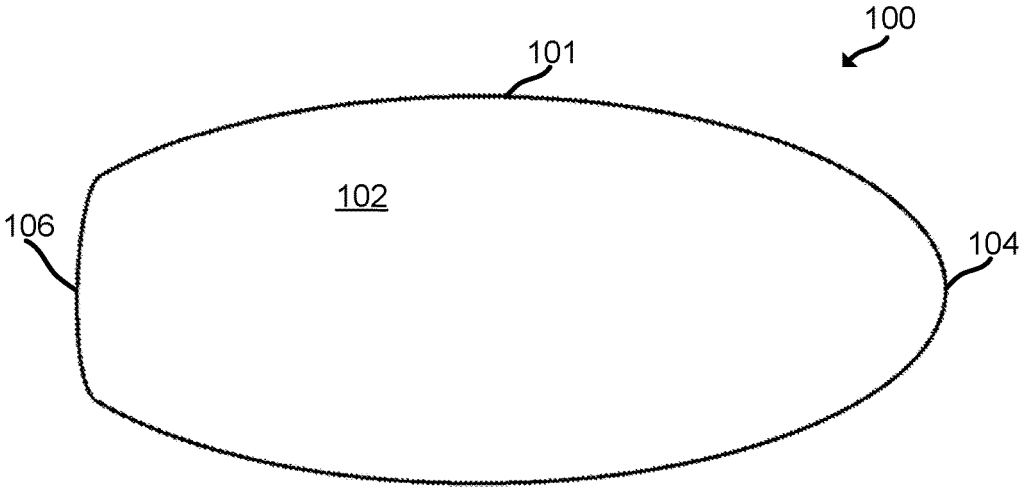
FIG. 1 illustrates a top view of a hydrofoil watercraft, in accordance with one or more implementations.

FIG. 1 illustrates a view of a hydrofoil watercraft, in particular, a hydrofoil board 100, in accordance with one or more implementations. However, those skilled in the art may recognize that one or more features and/or functionality described herein may be carried out on other watercraft, powered and non-powered, without departing from the scope and intent of the present disclosure.

It is noted that terms such as "fore" and "aft" used herein may refer to conventional use of such terms as applied to conveying spatial orientation in a marine environment or location on a vessel. The use of these terms with various components should therefore be easily understood by a person skilled in the art as related to orientation, direction, and/or disposition. Further, some directions may be specifically defined herein and/or shown in the figures.

The hydrofoil board 100 may comprise one or more of a body 101, a hydrofoil assembly (not shown in FIG. 1), and/or other components. The body 101 may have one or more of a deck surface 102 (e.g., a top surface) configured to support a rider, a bottom surface (not shown in FIG. 1) opposite the deck surface 102, and/or other surfaces and/or features. The body 101 may have a fore end 104 and an aft end 106. The fore end 104 may comprise a front end of the body 101 and may be what is generally referred to as the "nose". The aft end 106 may comprise a rear end of the body 101 and may be what is generally referred to as the "tail". An aft-to-fore direction (e.g., from the aft end 106 to the fore end 104) may define a direction of travel of the hydrofoil board 100 during use. In some implementations, the deck surface 102 may be substantially even across the body 101 between the fore end 104 and the aft end 106. In some implementations, "substantially even" may mean that the deck surface 102 is formed without breaks or irregularities between the fore end 104 and the aft end 106 and/or that the deck surface 102 lies on a single plane. In some implementations, the deck surface 102 may be substantially flat. In some implementations, the deck surface 102 may exhibit some curvature due to a curvature of the body 101 and/or portion of the body 101 (e.g., "rocker"). It is also contemplated that the deck surface 102 may include and/or may be modified to include additional components such as foot bindings, a cushion (e.g., "stomp pad"), camera mounts, and/or other devices.

Figure 2:
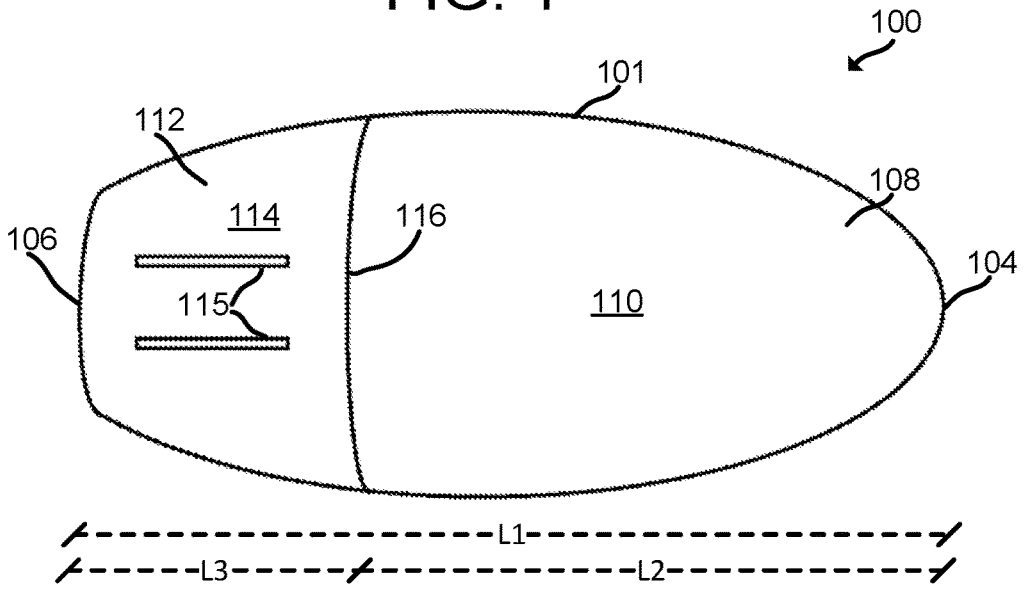
FIG. 2 illustrates a bottom view of a hydrofoil watercraft, in accordance with one or more implementations.

In FIG. 2 showing a bottom view of the hydrofoil board 100, the body 101 may be comprised of one or more of a fore portion 108, an aft portion 112, a step transition 116 between the fore portion 108 and the aft portion 112, and/or other portions and/or components. The fore portion 108 may be disposed toward a front end (e.g., fore end 104). The aft portion 112 may be disposed toward a rear end (e.g., aft end 106).

The body 101 may have an overall length, "L1". The overall length L1 may be measured from the fore end 104 to the aft end 106. In some implementations, the fore end 104 may be curved to a point and/or may have other shapes. The overall length L1 may be measured from the point and/or a central part of a curve of the fore end 104. In some implementations, the aft end 106 may be truncated, may be curved, and/or may have other shapes found in surfboard designs. The overall length L1 may be measured from the point or a central part of the aft end 106.

The overall length L1 may be a sum of a length "L2" of the fore portion 108 and a length "L3" of the aft portion 112. The length L2 may be measured from the fore end 104 to the step transition 116. The length L3 may be measured from the step transition 116 to the aft end 106. The step transition 116 may be flat, curved, or have other shapes. Measuring from the step transition 116 may be approximated from a central part of the step transition 116 and/or other part.

In some implementations, the length L2 of the fore portion 108 may be more than one half and less than seven eighths of the overall length L1. In some implementations, the length L2 of the fore portion 108 may comprise approximately one half of the overall length L1. In some implementations, the length L2 of the fore portion 108 may be more than one half of the overall length L1. In some implementations, the length L2 of the fore portion 108 may comprise approximately two thirds of the overall length L1. In some implementations, the length L2 of the fore portion 108 may comprise approximately five eighths of the overall length L1. In some implementations, the length L2 of the fore portion 108 may comprise more than two thirds of the overall length L1. In some implementations, the length L2 of the fore portion 108 may comprise approximately four fifths of the overall length L1. In some implementations, the length L2 of the fore portion 108 may comprise more than four fifths of the overall length L1.

The fore portion 108 may form a hull. The fore portion 108 forming the hull may provide the majority of the buoyancy for a rider atop the hydrofoil board 100. The body 101 may have a volume. In some implementations, the fore portion 108 may form between one half and seven eighths of the volume of the body 101. The body 101 may have a volume. In some implementations, the fore portion 108 may form five eighths of the volume of the body 101. In some implementations, the fore portion 108 may form more seven eighths of the volume of the body 101. In some implementations, the fore portion 108 may form about ninety percent of the volume of the body 101. In some implementations, the fore portion 108 may form approximately two thirds of the volume of the body 101. In some implementations, the fore portion 108 may form more than two thirds of the volume of the body 101. In some implementations, the fore portion 108 may form approximately fourth fifths of the volume of the body 101. In some implementations, the fore portion 108 may form more than fourth fifths of the volume of the body 101.

As shown in FIG. 2, the fore portion 108 may have a planing surface 110. The planing surface 110 may provide a surface upon which the hydrofoil board 100 planes atop a surface of a body of water. The planing surface 110 may form part of the bottom surface of the body 101.

The aft portion 112 may have an aft bottom surface 114. The aft bottom surface 114 may form part of the bottom surface of the body 101. The aft portion 112 may be configured to mount a hydrofoil assembly (not shown in FIG. 2) on or through the aft bottom surface 114. The aft portion 112 may include one or more mounting components 115 configured to facilitate the mounting of the hydrofoil assembly on or through the aft bottom surface 114. The one or more mounting components 115 may include conventional mounting components typically found in surfboards and/or hydrofoil watercraft. By way of non-limiting illustration, the one or more mounting components 115 may include one or more channels, one or more recesses, one or more plugs, and/or other devices. In some implementations, the one or more mounting components 115 may include one or more devices typically found in fin boxes of surfboards configured to mount removable fins.

Figure 3:
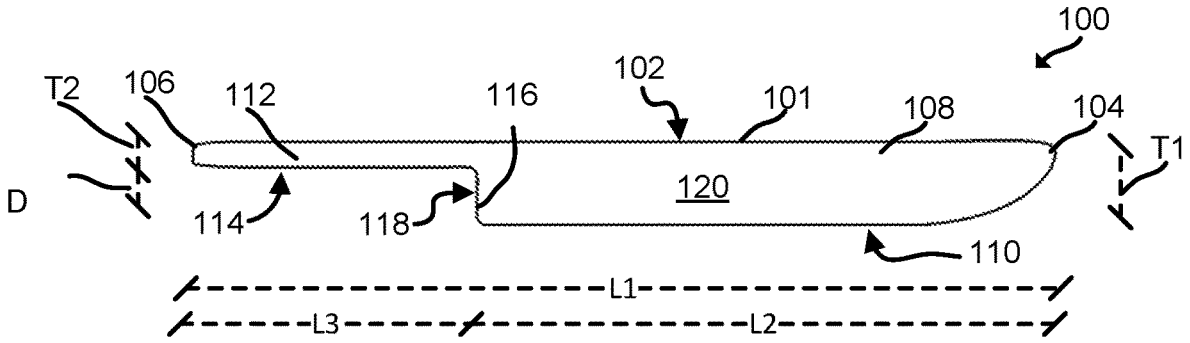
FIG. 3 illustrates a side view of a hydrofoil watercraft, in accordance with one or more implementations.

The aft portion 112 may be configured such that it may extend from the fore portion 108. The aft portion 112 may extend from the fore portion 108 such that the aft portion 112 is an extension of the hull formed by the fore portion 108. In FIG. 3 showing a side view, aft portion 112 may extend from the fore portion 108 such that the deck surface 102 may be substantially even across the fore portion 108 and the aft portion 112 of the body 101. In some implementations, "substantially even" may mean that the deck surface 102 is formed without breaks or irregularities between the fore portion 108 and the aft portion 112 and/or that the deck surface 102 lies on a single plane. In some implementations, the deck surface 102 may be substantially flat. In some implementations, the deck surface 102 may exhibit some curvature due to a curvature of the body 101 and/or portion of the body 101 (e.g., rocker).

In some implementations, the aft bottom surface 114 and the planing surface 110 may be on uneven planes. In some implementations, "on uneven planes" may mean that bottom surface of the body 101 is formed with a break between the fore portion 108 and the aft portion 112 and/or that the aft bottom surface 114 and the planing surface 110 lie on different, offset, planes. In some implementations, the break between the fore portion 108 and the aft portion 112 may be the step transition 116.

In some implementations, the fore portion 108 may have a fore cross-sectional thickness T1 between the deck surface 102 and the planing surface 110. The aft portion 112 may have an aft cross-sectional thickness T2 between the deck surface 102 and the aft bottom surface 114. In some implementations, the aft cross-sectional thickness T2 between the deck surface 102 and the aft bottom surface 114 may be less than the fore cross-sectional thickness T1 between the deck surface 102 and the planing surface 110. In some implementations, the thickness may be measured from centerline along a longitudinal axis of the body 101 and/or at other locations.

In some implementations, the fore cross-sectional thickness T1 may be in a range of one and a half to five times as thick as the aft cross-sectional thickness T2. In some implementations, the fore cross-sectional thickness T1 may be about twice as thick as the aft cross-sectional thickness T2. In some implementations, the fore cross-sectional thickness T1 may be about three times as thick as the aft cross-sectional thickness T2. In some implementations, the fore cross-sectional thickness T1 may be more than three times as thick as the aft cross-sectional thickness T2. In some implementations, the fore cross-sectional thickness T1 is about one and a half times as thick as the aft cross-sectional thickness T2. In some implementations, a ratio of T1:T2 may be 1.5:1. In some implementations, a ratio of T1:T2 may be 2:1. In some implementations, a ratio of T1:T2 may be 3:1. In some implementations, a ratio of T1:T2 may be 4:1. In some implementations, a ratio of T1:T2 may be 5:1.

In FIG. 3, the body 101 may include a side surface 120. The side surface 120 may form what is conventionally referred to as the "rail". The other side may be a mirror image of the view in FIG. 3.

In FIG. 3, the planing surface 110 of the fore portion 108 may terminate at the step transition 116. The step transition 116 may therefore be disposed between the fore portion 108 and the aft portion 112. The step transition 116 may form a transition surface 118 connecting the aft bottom surface 114 to the planing surface 110. The transition surface 118 may form part of the bottom surface. In some implementations, the step transition 116 may form a sharp (e.g., abrupt) transition between the fore portion 108 and the aft portion 112. By way of non-limiting illustration, the step transition 116 may be configured such that the transition surface 118 may be substantially orthogonal to the aft bottom surface 114 and/or the planing surface 110. However, the step transition 116 may be configured in other ways, such as being sloped (see, e.g., FIG. 5).

The step transition 116 may bridge an offset distance, D, between the aft bottom surface 114 and the planing surface 110. In some implementations, the offset distance D may be in a range of two to twenty five centimeters. In some implementations, the offset distance D may be in a range of five to twenty centimeters. In some implementations, the offset distance D may be in a range of ten to fifteen centimeters. In some implementations, the offset distance D may be more than twenty five centimeters. In some implementations, the offset distance D may be less than two centimeters. In some implementations, the offset distance D may be about ten centimeters.

The bottom surface of the body 101 may have a bottom surface area. The bottom surface area may be measured as a sum of one or more of a fore surface area of the planing surface 110, an aft surface area of the aft bottom surface 114, a transition surface area of the transition surface 118, and/or other surface areas. In some implementations, the fore surface area may comprise about one half and seven eighths of the bottom surface area of the body 101. In some implementations, the fore surface area may form more seven eighths of the bottom surface area of the body 101. In some implementations, the fore surface area may form about ninety percent of the bottom surface area of the body 101. In some implementations, the fore surface area may form approximately two thirds of the bottom surface area of the body 101. In some implementations, the fore surface area may form more than two thirds of the bottom surface area of the body 101. In some implementations, the fore surface area may form approximately fourth fifths of the bottom surface area of the body 101. In some implementations, the fore surface area may form more than fourth fifths of the bottom surface area of the body 101.

Figure 13:
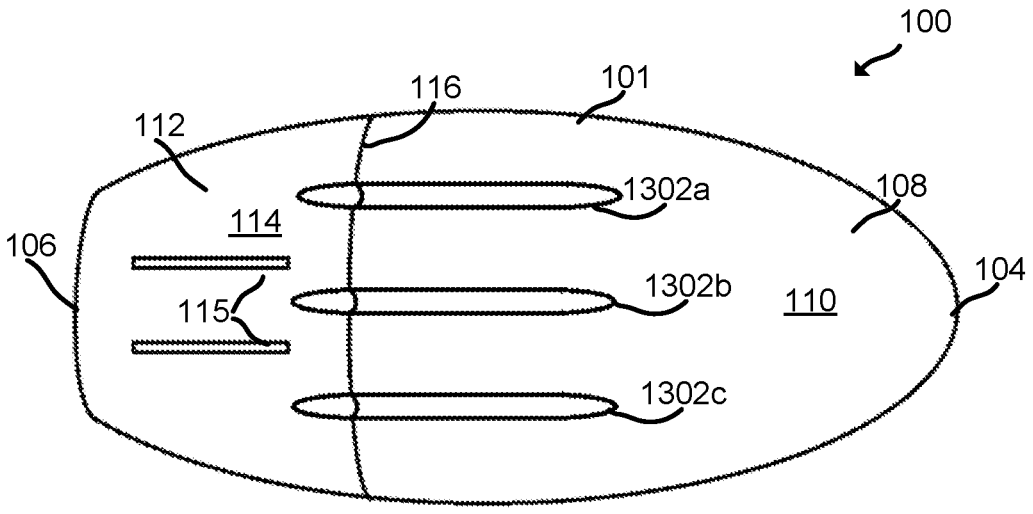
FIG. 13 illustrates a hydrofoil watercraft including one or more channels, in accordance with one or more implementations.

FIG. 13 shows an implementation of the hydrofoil board 100 where the bottom surface of the body 101 includes one or more channels (depicted as channels 1302*a-c*). The one or more channels 1302*a-c* may be communicating between the fore portion 108 and the aft portion 112 through the step transition 116. Accordingly, in some implementations, the measurements of the cross-sectional thicknesses T1 and/or T1, and the offset distance D (FIG. 3) may be made from the thickest parts the body 101 not including the one or more channels 1302*a-c*. In some implementations, a given channel may include a lengthwise groove, or furrow, having its "lowest" surface even with the plane of the aft bottom surface 114, communicating through the step transition 116 and the fore portion 108, and terminating at or before the fore end 104. It is noted that the depiction in FIG. 13 is for illustrative purposes only and not to be considered limiting. Instead, those skilled in the art may appreciate other ways that channel(s) may be formed and/or otherwise incorporated into the bottom surface of the body 101.

Figure 4:
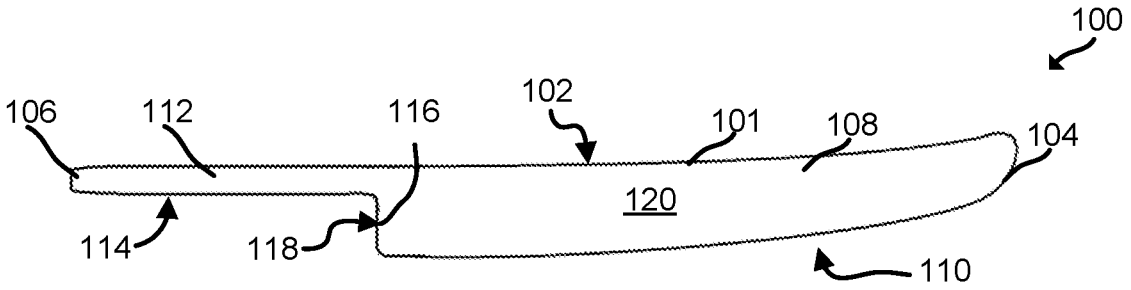
FIG. 4 illustrates a side view of a hydrofoil watercraft, in accordance with one or more implementations.

FIG. 4 shows an implementation of the hydrofoil board 100 where the fore portion 108 may be curved from the fore end 104 to the step transition 116. It is noted that the depiction in FIG. 4 is for illustrative purposes only and is not to be considered limiting. Instead, those skilled in the art may appreciate other ways to incorporate curvature, or "rocker", into the wave ride hydrofoil board 100.

Figure 5:
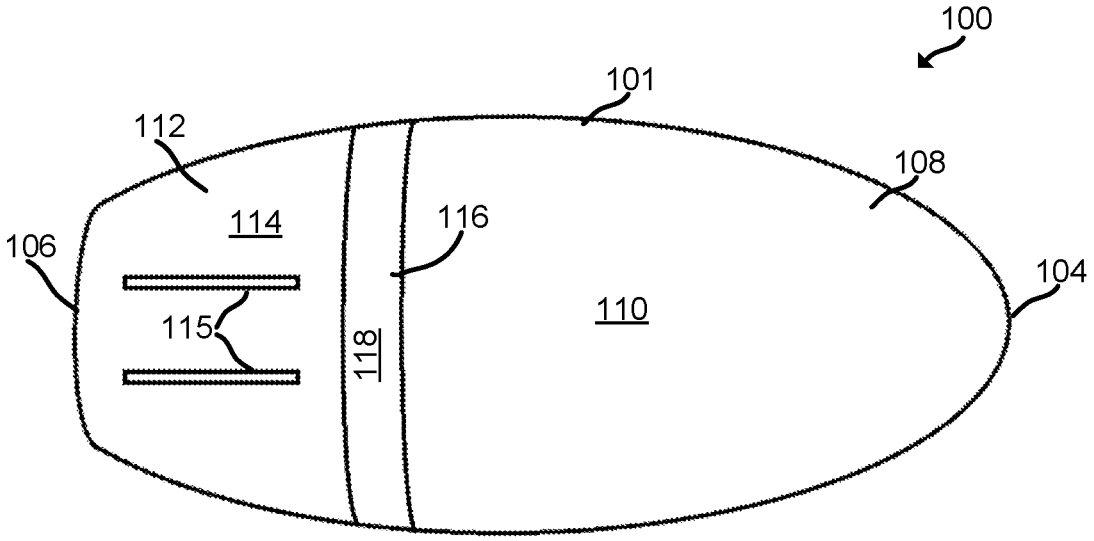
FIG. 5 illustrates a bottom view of a hydrofoil watercraft, in accordance with one or more implementations.
Figure 6:
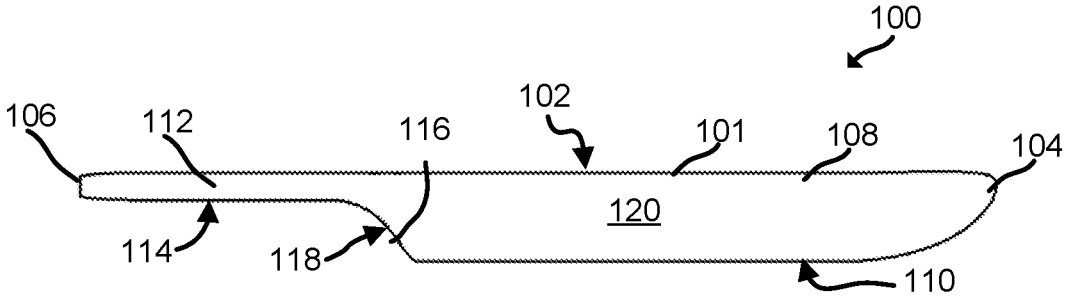
FIG. 6 illustrates a side view of a hydrofoil watercraft, in accordance with one or more implementations.

FIG. 5 and FIG. 6 illustrate another implementation of the hydrofoil board 100 where the step transition 116 provides a gradual transition between fore portion 108 and the aft portion 112. The step transition 116 may form the transition surface 118 connecting the aft bottom surface 114 to the planing surface 110. The transition surface 118 may form part of the bottom surface. In some implementations, the step transition 116 may form the gradual transition between the fore portion 108 and the aft portion 112. By way of non-limiting illustration, the step transition 116 may be configured such that the transition surface 118 angles toward the aft end 106 connecting the aft bottom surface 114 to the planing surface 110. The transition surface 118 may angle toward the aft end 106 in a line, an arch or curve, and/or in other transition.

Figure 7:
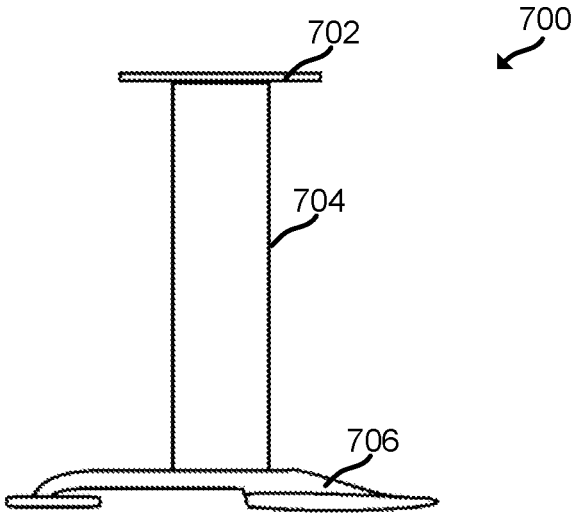
FIG. 7 illustrates a hydrofoil assembly, in accordance with one or more implementations.

FIG. 7 illustrates a hydrofoil assembly 700, in accordance with one or more implementations. The hydrofoil assembly 700 may include one or more of a mounting plate 702, a strut 704, one or more wings 706 (sometimes referred to as "hydrofoil wings" or "hydrofoils"). In some implementations, the mounting plate 702 may include one or more projections which insert into through an after bottom surface into one or more mounting components of an aft portion of a hydrofoil board. It is noted that the depiction and description of the hydrofoil assembly 700 is for illustrative purposes only and not to be considered limiting. Instead, it is to be understood that other types, forms, and/or configurations of hydrofoil assemblies suitable for a hydrofoil watercraft are within the scope of this disclosure.

Figure 8:
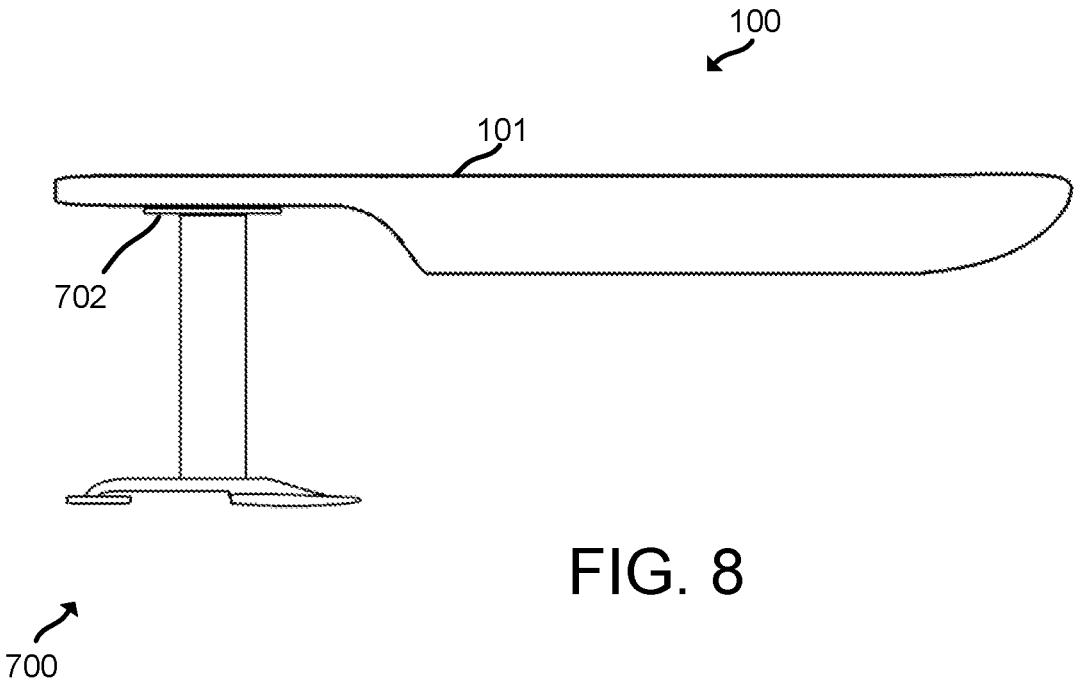
FIG. 8 illustrates a hydrofoil watercraft including a hydrofoil assembly, in accordance with one or more implementations.

FIG. 8 illustrates a hydrofoil watercraft, specifically the hydrofoil board 100, including the hydrofoil assembly 700 of FIG. 7, in accordance with one or more implementations. In some implementations, the hydrofoil assembly 700 may mount to an aft portion of a hydrofoil board via the mounting plate 700 and one or more mounting components on the hydrofoil board using conventional hardware.

Figure 9:
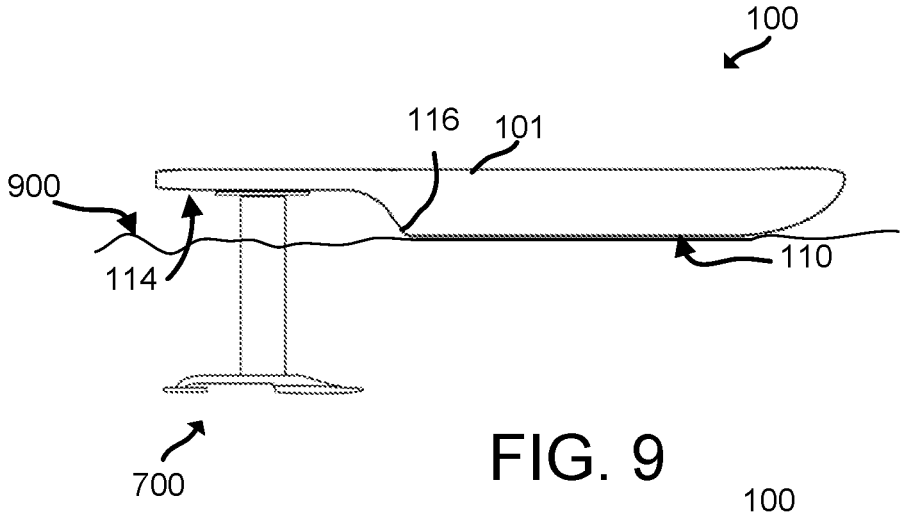
FIG. 9 illustrates a hydrofoil watercraft including hydrofoil assembly planing atop a surface of water, in accordance with one or more implementations.
Figure 10:
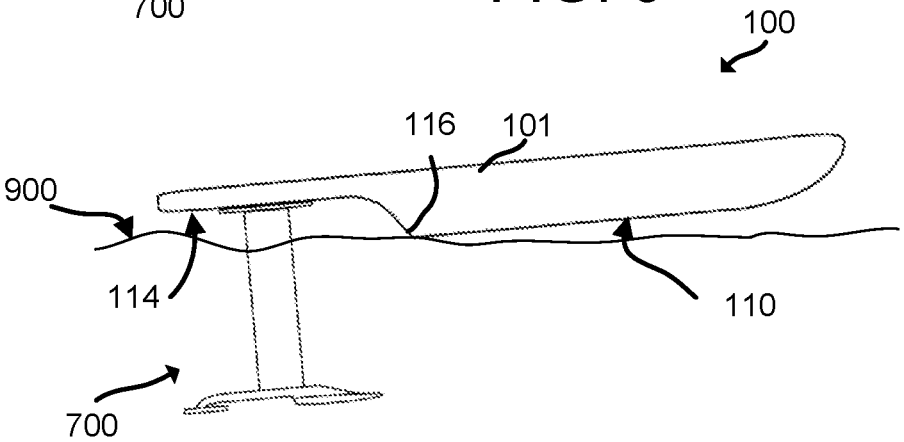
FIG. 10 illustrates the hydrofoil watercraft including hydrofoil assembly of FIG. 9 showing a planing surface leaving the surface of the water at a step transition, in accordance with one or more implementations.
Figure 11:
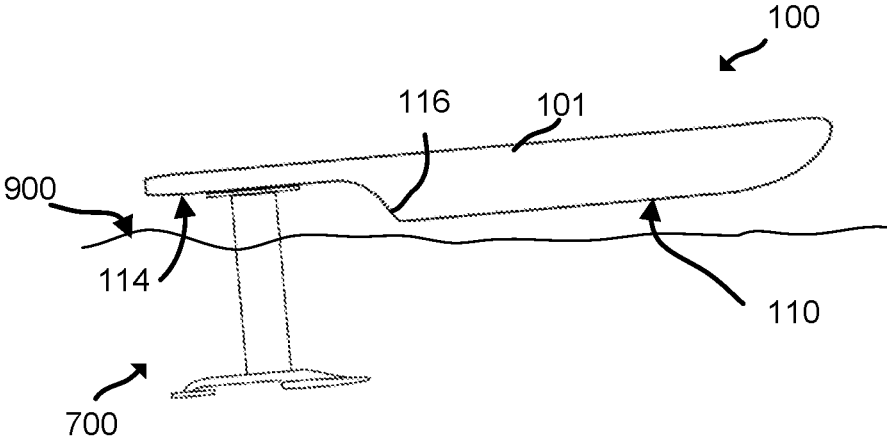
FIG. 11 illustrates the hydrofoil watercraft including hydrofoil assembly of FIG. 9 showing the hydrofoil watercraft being fully supported by the hydrofoil assembly, in accordance with one or more implementations.

FIGS. 9-11 depict a series of graphics showing the use and advantage(s) of the hydrofoil board 100 including the hydrofoil assembly 700. FIG. 9 illustrates hydrofoil board 100 including the hydrofoil assembly 700 planing atop a surface 900 of water, in accordance with one or more implementations. During in initial take off, the planing surface 110 may provide a surface upon which the hydrofoil board 100 planes atop the surface 900. Given the offset configuration of board 100, the aft bottom surface 114 may already be displaced a distance from the surface 900 of the water so that the aft bottom surface 114 may not provide a planing surface.

FIG. 10 illustrates the hydrofoil board 100 including the hydrofoil assembly 700 of FIG. 9 showing the planing surface 110 leaving the surface 900 of the water at the step transition 116, in accordance with one or more implementations. Upon reaching a predetermined speed, the planing surface 110 may release from the surface 900 of the body of water at the step transition 116 hereby causing the hydrofoil board 100 to be fully supported by the hydrofoil assembly 700. Because the step transition 116 is positioned closer to the nose (compared to the distance from the tail to the nose), the board 100 leaves the surface 900 of the water sooner than if the bottom surface of the board 100 was continuous and even from nose to tail or continuous and even from nose to where the foil attaches. Since the board 100 can release from the surface 900 of the water sooner than conventional boards, the rider is able to effective ride on the foil sooner and therefore gain control of the board 100 sooner. FIG. 11 illustrates hydrofoil board 100 including the hydrofoil assembly 700 of FIG. 9 showing the hydrofoil board 100 being fully supported by the hydrofoil assembly 700, in accordance with one or more implementations. When fully supported by the hydrofoil assembly 700, a rider is able to achieve full control of the board 100 as intended (e.g., referred to as "foiling").

Figure 14:
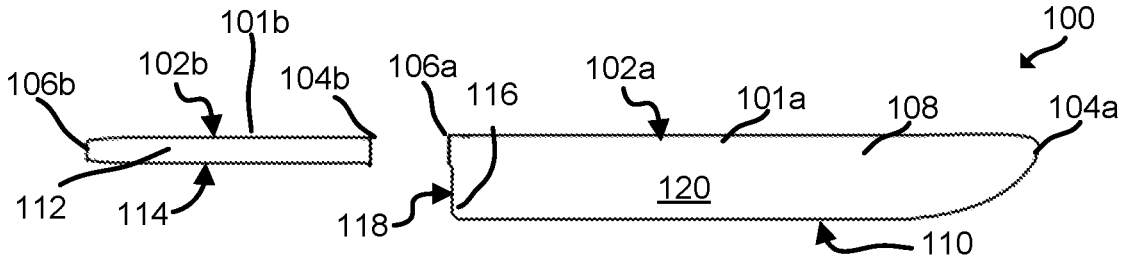
FIG. 14 illustrates a two-piece hydrofoil watercraft, in accordance with one or more implementations.

FIG. 14 illustrates the hydrofoil board 100 formed of a two-piece assembly. The hydrofoil board 100 may include one or more of a fore body 101*a*, an aft body 101*b*, and/or other portions. The fore body 101*a* may comprise the fore portion 108 of the board 100 (when assembled). The aft body 101*b* may comprise the aft portion 112 of the board 100 (when assembled). The two-piece assembly may allow the board 100 to be more easily stored and/or transported. Further, one or more of the pieces may be interchangeable so the rider can create boards with varying dimensions by switching out different pieces.

The fore body 101*a* may have one or more of a first deck surface 102*a* (e.g., a top surface), the planing surface 110 opposite the first deck surface 102*a*, and/or other surfaces and/or features. The fore body 101*a* may have a first fore end 104*a* and a first aft end 106*a*. The first fore end 104*a* may comprise a front end of the fore body 101*a* and may be what is generally referred to as the "nose". The first aft end 106*a* may comprise a rear end of the fore body 101*a* and may comprise the step transition 106 and transition surface 118. In some implementations, the first deck surface 102*a* may be substantially even across the fore body 101*a* between the first fore end 104*a* and the first aft end 106*a*.

The aft body 101*b* may have one or more of a second deck surface 102*b* (e.g., a top surface), the aft bottom surface 114 opposite the second deck surface 102*b*, and/or other surfaces and/or features. The aft body 101*b* may have a second fore end 104*b* and a second aft end 106*b*. The second fore end 104*b* may comprise a front end of the aft body 101*b* and may comprise a contact surface for attaching to the first aft end 106*a* of the fore body 101*a*. The second aft end 106*b* may comprise a rear end of the aft body 101*b* and may generally form the "tail" of the board 100. In some implementations, the second deck surface 102*b* may be substantially even across the aft body 101*b* between the second fore end 104*b* and the second aft end 106*b*.

In some implementations, the fore body 101*a* and the aft body 101*b* may be configured to removably attach to one another. By way of non-limiting illustration, the second fore end 104*b* of the aft body 101*b* may attached to the first aft end 106*a* of the fore body 101*a*. In some implementations, one or both of the fore body 101*a* or the aft body 101*b* may include one or more fasteners (not shown), and/or other components. In some implementations, the one or more fasteners may include latches, locks, and/or other fasteners. In some implementations, other components (not shown) may include devices to align the two pieces and/or provide structural support at the point of attachment. By way of non-limiting illustration, one or more dowels, pegs, and/or other components may be formed on one or both of the second fore end 104*b* of the aft body 101*b* or the first aft end 106*a* of the fore body 101*a*. One or both of the second fore end 104*b* of the aft body 101*b* or the first aft end 106*a* of the fore body 101*a* may then include complementary passages configured to receive the one or more dowels, pegs, and/or other components as the two pieces come together. It is noted that the depiction and accompanying descriptions of FIG. 14 are for illustrative purposes only and not to be considered limiting. Instead, those skilled in the art may appreciate other removable attachment techniques suitable for the intended purpose.

Figure 15:
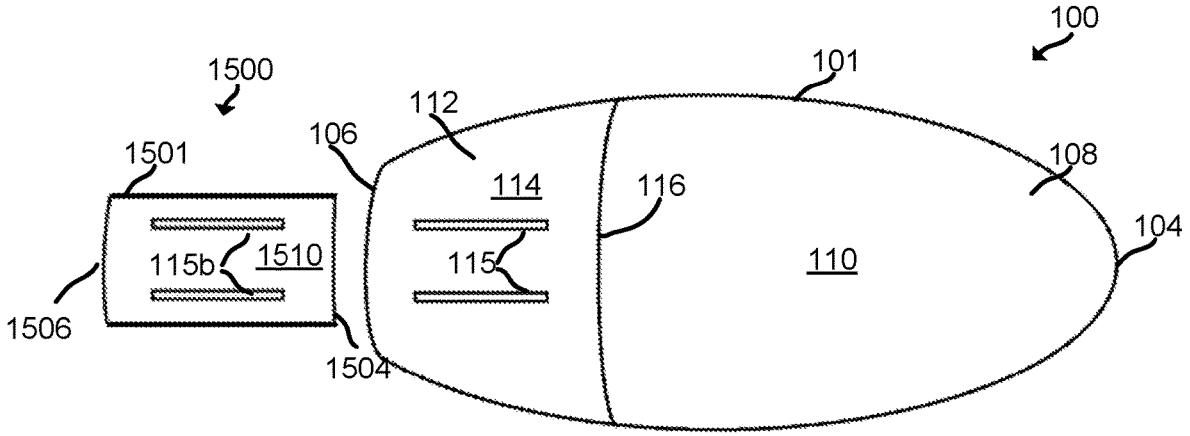
FIG. 15 illustrates a bottom view of a hydrofoil watercraft including a removable attachment in a detached position, in accordance with one or more implementations.

FIG. 15 illustrates a bottom view of the hydrofoil board 100 including a removable attachment 1500 in a detached position, in accordance with one or more implementations. The removable attachment 1500 may comprise a body 1501 configured to removably attach to the aft portion 112 of the body 100. The body 1501 of the removable attachment 1500 may include one or more of a fore end 1504, an aft end 1506 opposite the fore end 1504, a bottom surface 1510, a top surface (not shown) opposite the bottom surface 1510, one or more edges 1520 (see, e.g., edge 1520 in FIG. 17) and/or other features.

The removable attachment 1500 may be configured to offset the mounting component(s) for a hydrofoil assembly a distance from the aft bottom surface 114 and closer to (if not even with) the plane of the planning surface 110. The body 1501 of the removable attachment 1500 may comprise one or more mounting components 115*b* included on a bottom surface 1510. The removable attachment 1500 may attach to the aft portion 112 via the one or more mounting components 115 of the aft portion 112 using conventional hardware. However, in some implementations, attachment-specific fasteners and/or fastening mechanisms may be utilized (not shown).

Figure 16:
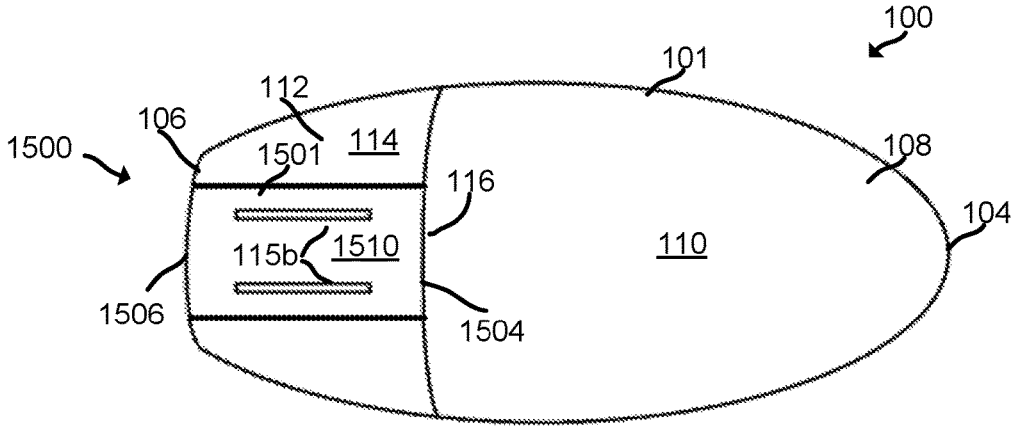
FIG. 16 illustrates a bottom view of a hydrofoil watercraft including a removable attachment in an attached position, in accordance with one or more implementations.
Figure 17:
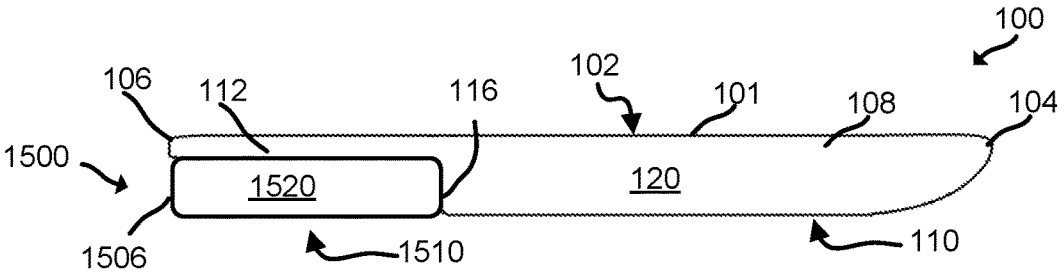
FIG. 17 illustrates a side view of a hydrofoil watercraft including a removable attachment in an attached position, in accordance with one or more implementations.

When attached, as shown in the bottom view of FIG. 16 and side view of FIG. 17, the one or more mounting components 115*b* of the removable attachment 1500 may be offset from the aft bottom surface 114 by an offset distance. The offset distance may be indicated by a thickness of the body 1501 of the measured from the top surface to the bottom surface 1510. When attached, the one or more mounting components 115*b* may be positioned in substantially the same position of as the one or more mounting components 115, albeit offset the offset distance. This configuration may effectively lengthen the hydrofoil assembly and/or the ride height of the hydrofoil board 100 when the hydrofoil assembly is attached, and the rider is foiling. The body 1501 of the removable attachment 1500 may have a width that is less than a width of the aft portion 112 so that advantages of the step transition 116 may still be maintained. That is, the removable attachment 1500 may only cover a portion of the aft portion 112 including the mounting components as opposed to the entirety of the aft portion 112 which would effectively eliminate the advantages of the step transition 116. In some implementations, the body 1501 may be substantially rectangular in shape. In some implementations, the body 1501 may taper from one end to the other. In some implementations, the body 1501 may be narrower at the aft end 1506 and wider at the fore end 1504.

As shown in FIG. 17, the body 1501 of the removable attachment 1500 may have a thickness such that the bottom surface 1510 may be substantially even with the planing surface 110 of the fore portion 108. However, the body 1501 of the removable attachment 1500 may have other thicknesses such that the bottom surface 1510 may be disposed in a plane between the plane of the planing surface 110 and the plane of the aft bottom surface 114. In some implementations, although the inclusion of the removable attachment 1500 may provide additional surfaces needing to detach from the surface of the water, the rider may appreciate the added effective length of the hydrofoil assembly when mounted.

Figure 12:
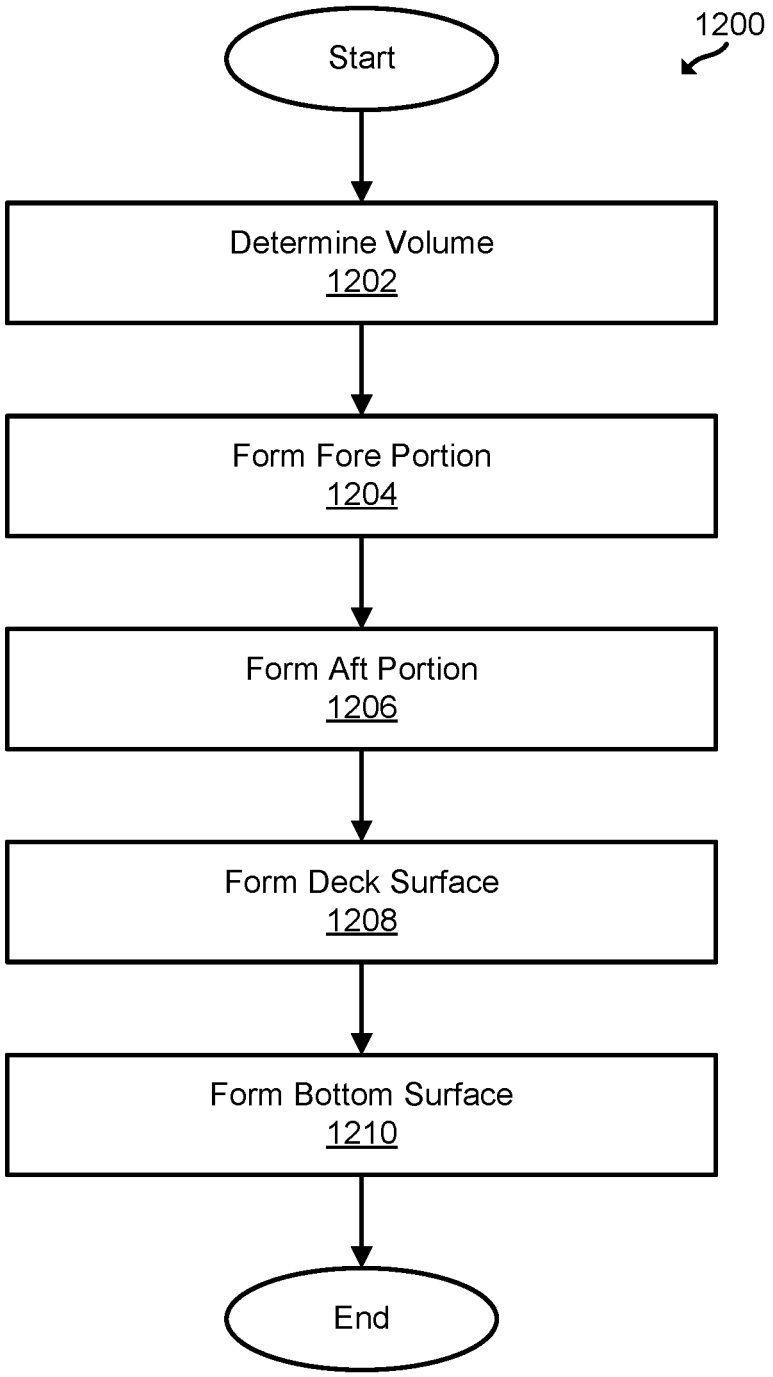
FIG. 12 illustrates a method of manufacture of a hydrofoil watercraft.

FIG. 12 illustrates a method 1200 of manufacture of a hydrofoil watercraft, in accordance with one or more implementations. The operations of method 1200 presented below are intended to be illustrative. In some implementations, method 1200 may be accomplished with one or more additional operations not described, and/or without one or more of the operations discussed. Additionally, the order in which the operations of method 1200 are illustrated in FIG. 12 and described below is not intended to be limiting.

In some implementations, method 1200 may be implemented using manual and/or automated manufacturing techniques. A manual manufacturing techniques may include one or more forming techniques used by skilled artisans in watercraft and/or surfboard manufacture. A forming technique may include one or more of cutting, sanding and/or otherwise shaping a core substrate, such as a polyurethane foam, polystyrene, expanded polystyrene (EPS), wood, and/or other materials. A forming technique may include coating a shaped core substrate with one or more of fiberglass, resin, epoxy, carbon fiber, and/or other materials. Other techniques known to skilled artisans in watercraft and/or surfboard manufacture are also within the scope of the present disclosure. An automated manufacturing technique may include machines and one or more processing devices. The one or more processing devices and/or machines may include one or more devices executing some or all of the operations of method 1200 in response to instructions stored electronically on an electronic storage medium. The one or more processing devices and/or machines may include one or more devices configured through hardware, firmware, and/or software to be specifically designed for execution of one or more of the operations of method 1200.

An operation 1202 may determine a volume of a body of a hydrofoil board. In some implementations, the volume may be determined based on an expected and/or actual weight of a rider. The body may have a deck surface configured to support a rider, a bottom surface opposite the deck surface, and/or other components. The bottom surface may have more than one part.

An operation 1204 may form a fore portion of the body toward a front end of the hydrofoil board based on the volume. The fore portion may comprise more than two thirds of the volume of the body. The fore portion may form a hull having a planing surface upon which the hydrofoil board planes atop a surface of a body of water. The planing surface may form part of the bottom surface of the body.

An operation 1206 may form an aft portion of the body extending from the fore portion toward a rear end of the hydrofoil board based on the volume. The aft portion may have an aft bottom surface forming part of the bottom surface of the body. The aft portion may be configured to mount a hydrofoil assembly on or through the aft bottom surface.

An operation 1208 may form the deck surface. The deck surface may be formed substantially even across the fore portion and the aft portion of the body.

An operation 1210 may form the bottom surface. Forming the bottom surface may include forming the aft bottom surface and the planing surface on uneven planes such that an aft cross-sectional thickness between the deck surface and the aft bottom surface may be less than a fore cross-sectional thickness between the deck surface and the planing surface.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A hydrofoil board comprising:

a body, the body having a deck surface configured to support a rider, and a bottom surface opposite the deck surface, the body comprising:

a fore portion toward a front end of the hydrofoil board, the fore portion forming a hull and having a planing surface upon which the hydrofoil board planes atop a surface of a body of water, the planing surface forming part of the bottom surface of the body; and an aft portion toward a rear end of the hydrofoil board, the aft portion extending from the fore portion, the aft portion having an aft bottom surface forming part of the bottom surface of the body, the aft portion being configured to mount a hydrofoil assembly on or through the aft bottom surface;

wherein the deck surface is substantially even across the fore portion and the aft portion of the body;

wherein the aft bottom surface and the planing surface are on uneven planes such that an aft cross-sectional thickness between the deck surface and the aft bottom surface is less than a fore cross-sectional thickness between the deck surface and the planing surface;

wherein the planing surface of the fore portion terminates at a step transition disposed between the fore portion and the aft portion, wherein the step transition forms a transition surface connecting the aft bottom surface to the planing surface, the transition surface forming part of the bottom surface;

wherein the step transition bridges an offset distance between the aft bottom surface and the planing surface; and wherein the offset distance is in a range of 10 to 15 centimeters.

2. The hydrofoil board of claim 1, wherein the body is configured such that, upon reaching a predetermined speed of the hydrofoil board, the planing surface releases from the surface of the body of water at the step transition hereby causing the hydrofoil board to be fully supported by the hydrofoil assembly.

3. The hydrofoil board of claim 1, wherein the fore portion is curved from the front end to the step transition.

4. A hydrofoil board comprising:

a body, the body having a deck surface configured to support a rider, and a bottom surface opposite the deck surface, the body comprising:

a fore portion toward a front end of the hydrofoil board, the fore portion forming a hull and having a planing surface upon which the hydrofoil board planes atop a surface of a body of water, the planing surface forming part of the bottom surface of the body; and an aft portion toward a rear end of the hydrofoil board, the aft portion extending from the fore portion, the aft portion having an aft bottom surface forming part of the bottom surface of the body, the aft portion being configured to mount a hydrofoil assembly on or through the aft bottom surface;

wherein the deck surface is substantially even across the fore portion and the aft portion of the body;

wherein the aft bottom surface and the planing surface are on uneven planes such that an aft cross-sectional thickness between the deck surface and the aft bottom surface is less than a fore cross-sectional thickness between the deck surface and the planing surface;

wherein the planing surface of the fore portion terminates at a step transition disposed between the fore portion and the aft portion, wherein the step transition forms a transition surface connecting the aft bottom surface to the planing surface, the transition surface forming part of the bottom surface; and wherein the bottom surface has a bottom surface area, the bottom surface area including a fore surface area of the planing surface, an aft surface area of the aft bottom surface, and a transition surface area of the transition surface, and wherein the fore surface area is about two thirds of the bottom surface area.

5. A hydrofoil board comprising:

a body, the body having a deck surface configured to support a rider, and a bottom surface opposite the deck surface, the body comprising:

a fore portion toward a front end of the hydrofoil board, the fore portion forming a hull and having a planing surface upon which the hydrofoil board planes atop a surface of a body of water, the planing surface forming part of the bottom surface of the body; and an aft portion toward a rear end of the hydrofoil board, the aft portion extending from the fore portion, the aft portion having an aft bottom surface forming part of the bottom surface of the body, the aft portion being configured to mount a hydrofoil assembly on or through the aft bottom surface;

wherein the deck surface is substantially even across the fore portion and the aft portion of the body;

wherein the aft bottom surface and the planing surface are on uneven planes such that an aft cross-sectional thickness between the deck surface and the aft bottom surface is less than a fore cross-sectional thickness between the deck surface and the planing surface; and wherein the body has a volume, and the fore portion forms approximately five eighths of the volume of the body.

6. A hydrofoil board comprising:

a body, the body having a deck surface configured to support a rider, and a bottom surface opposite the deck surface, the body comprising:

a fore portion toward a front end of the hydrofoil board, the fore portion forming a hull and having a planing surface upon which the hydrofoil board planes atop a surface of a body of water, the planing surface forming part of the bottom surface of the body; and an aft portion toward a rear end of the hydrofoil board, the aft portion extending from the fore portion, the aft portion having an aft bottom surface forming part of the bottom surface of the body, the aft portion being configured to mount a hydrofoil assembly on or through the aft bottom surface;

wherein the deck surface is substantially even across the fore portion and the aft portion of the body;

wherein the aft bottom surface and the planing surface are on uneven planes such that an aft cross-sectional thickness between the deck surface and the aft bottom surface is less than a fore cross-sectional thickness between the deck surface and the planing surface; and wherein the fore portion comprising approximately five eighths of an overall length of the body.

7. The hydrofoil board of claim 1, further comprising the hydrofoil assembly.

8. The hydrofoil board of claim 7, wherein the hydrofoil assembly includes a strut, a mounting plate, and one or more wings.

9. The hydrofoil board of claim 1, wherein the aft portion includes one or more mounting components configured to facilitate the mounting of the hydrofoil assembly on or through the aft bottom surface.

10. The hydrofoil board of claim 1, wherein the hydrofoil board is non-powered and controlled by the rider.

11. The hydrofoil board of claim 1, wherein the fore cross-sectional thickness is about twice as thick as the aft cross-sectional thickness.

12. A hydrofoil board comprising:

a body, the body having a deck surface configured to support a rider, and a bottom surface opposite the deck surface, the body comprising:

a fore portion toward a front end of the hydrofoil board, the fore portion forming a hull and having a planing surface upon which the hydrofoil board planes atop a surface of a body of water, the planing surface forming part of the bottom surface of the body; and an aft portion toward a rear end of the hydrofoil board, the aft portion extending from the fore portion, the aft portion having an aft bottom surface forming part of the bottom surface of the body, the aft portion being configured to mount a hydrofoil assembly on or through the aft bottom surface;

wherein the deck surface is substantially even across the fore portion and the aft portion of the body;

wherein the aft bottom surface and the planing surface are on uneven planes such that an aft cross-sectional thickness between the deck surface and the aft bottom surface is less than a fore cross-sectional thickness between the deck surface and the planing surface; and wherein the fore cross-sectional thickness is about three times as thick as the aft cross-sectional thickness.

13. A method of manufacture of a hydrofoil board, the method comprising:

determining a volume of a body of the hydrofoil board, the body having a deck surface configured to support a rider, and a bottom surface opposite the deck surface;

forming a fore portion of the body toward a front end of the hydrofoil board based on the volume, the fore portion having more than two thirds of the volume of the body, the fore portion forming a hull and having a planing surface upon which the hydrofoil board planes atop a surface of a body of water, the planing surface forming part of the bottom surface of the body;

forming an aft portion of the body extending from the fore portion toward a rear end of the hydrofoil board based on the volume, the aft portion having an aft bottom surface forming part of the bottom surface of the body, the aft portion being configured to mount a hydrofoil assembly on or through the aft bottom surface;

forming the deck surface substantially even across the fore portion and the aft portion of the body;

forming the aft bottom surface and the planing surface on uneven planes such that an aft cross-sectional thickness between the deck surface and the aft bottom surface is less than a fore cross-sectional thickness between the deck surface and the planing surface; and forming a step transition between the fore portion and the aft portion, the step transition including a transition surface connecting the aft bottom surface to the planing surface, the transition surface forming part of the bottom surface;

wherein the step transition bridges an offset distance between the aft bottom surface and the planing surface; and wherein the offset distance is in a range of 10 to 15 centimeters.

14. A method of manufacture of a hydrofoil board, the method comprising:

determining a volume of a body of the hydrofoil board, the body having a deck surface configured to support a rider, and a bottom surface opposite the deck surface;

forming a fore portion of the body toward a front end of the hydrofoil board based on the volume, the fore portion having more than two thirds of the volume of the body, the fore portion forming a hull and having a planing surface upon which the hydrofoil board planes atop a surface of a body of water, the planing surface forming part of the bottom surface of the body;

forming an aft portion of the body extending from the fore portion toward a rear end of the hydrofoil board based on the volume, the aft portion having an aft bottom surface forming part of the bottom surface of the body, the aft portion being configured to mount a hydrofoil assembly on or through the aft bottom surface;

forming the deck surface substantially even across the fore portion and the aft portion of the body;

forming the aft bottom surface and the planing surface on uneven planes such that an aft cross-sectional thickness between the deck surface and the aft bottom surface is less than a fore cross-sectional thickness between the deck surface and the planing surface; and forming a step transition between the fore portion and the aft portion, the step transition including a transition surface connecting the aft bottom surface to the planing surface, the transition surface forming part of the bottom surface;

wherein the bottom surface has a bottom surface area, the bottom surface area including a fore surface area of the planing surface, an aft surface area of the aft bottom surface, and a transition surface area of the transition surface, and wherein the fore surface area is about two thirds of the bottom surface area.

* * * * *